US006006680A

United States Patent [19]

Quam et al.

[11] Patent Number: 6,006,680

[45] Date of Patent: Dec. 28, 1999

[54] PORTABLE STAGE ASSEMBLY

[75] Inventors: Grant S. Quam; Martin E. Thiede, both of Owatonna, Minn.

[73] Assignee: Wenger Corporation, Owatonna, Minn.

[21] Appl. No.: 08/975,042

[22] Filed: Nov. 18, 1997

[51] Int. Cl.[6] ..... A47B 3/00

[52] U.S. Cl. ..... 108/179; 108/169; 108/115

[58] Field of Search ..... 108/169, 167, 108/172, 173, 174, 175, 176, 115, 179; 52/7

[56] References Cited

U.S. PATENT DOCUMENTS

| | | | |
|---|---|---|---|
| 3,180,460 | 4/1965 | Liskey . | |
| 3,258,884 | 7/1966 | Wenger . | |
| 3,400,502 | 9/1968 | Scaggs . | |
| 3,425,179 | 2/1969 | Haroldson . | |
| 3,470,663 | 10/1969 | Tate . | |
| 4,026,221 | 5/1977 | Wilson . | |
| 4,054,096 | 10/1977 | Wilson . | |
| 4,301,627 | 11/1981 | Wilson . | |
| 4,327,650 | 5/1982 | Bue . | |
| 4,596,196 | 6/1986 | Gunter et al. | 108/169 |
| 4,779,542 | 10/1988 | Staten . | |
| 4,917,217 | 4/1990 | Rogers . | |
| 4,949,649 | 8/1990 | Terres . | |
| 5,117,596 | 6/1992 | Leslie . | |
| 5,325,640 | 7/1994 | Luedke . | |
| 5,349,789 | 9/1994 | Andert . | |
| 5,392,718 | 2/1995 | Stevens | 108/167 |
| 5,613,450 | 3/1997 | Wagner . | |

*Primary Examiner*—Jose V. Chen
*Attorney, Agent, or Firm*—Patterson & Keough, P.A.

[57] ABSTRACT

A portable stage platform includes a platform assembly having a mass and being shiftable between a stowed configuration and a performance configuration. The platform assembly has a platform that presents an upwardly directed performance surface when in the performance configuration and an opposed underside. The underside has a plurality of collapsible legs operably coupled thereto. The collapsible legs are shiftable between a collapsed configuration in which the collapsible legs are substantially flush with the underside and an extended configuration in which the collapsible legs are substantially transverse to the underside. The portable stage platform includes a platform base assembly that is shiftable between a stowed configuration and a performance configuration. The platform base assembly has apparatus for counterbalancing the mass of the platform assembly in order to minimize the effort required of an operator to shift the platform assembly between the stowed configuration and a performance configuration.

27 Claims, 10 Drawing Sheets

10
18
20
22
28
30
32
34
36
37
38
40
130a
130b
136
138
142
144
154
162
166
180
192
197

PORTABLE STAGE ASSEMBLY

TECHNICAL FIELD

The present invention relates to portable assemblies for supporting performers at height above a stage floor. More particularly, the present invention is counterbalanced and readily deployable between a stowed configuration and a performance configuration by a single operator.

BACKGROUND OF THE INVENTION

Devices providing temporary platforms above a floor have been known for many years. Such devices can be categorized in one of the two following categories: erectable in situ from a number of cooperative components and deployable from a stowed configuration. Typically, the erectable devices are more massive having a number of components that resuscitate a complex erection procedure requiring several individuals to assemble. The deployable devices on the other hand typically have rather complex linkages that unnecessarily increase the weight of the device. Even the deployable devices require several individuals to place the device in a performance configuration from a stowed configuration.

Neither the deployable nor the erectable devices provided for height adjustability further, both the deployable and the erectable devices required relatively extensive storage space and did not provide for a nestable feature. Both the deployable and erectable devices, being relatively massive, were not readily transportable between a storage location and a performance location. Finally, neither the deployable nor the erectable devices provided for any safety measures that would prevent a performer from falling from the portable stage device.

Accordingly, there is a need in the industry for a portable stage assembly that has a relatively simple linkage structure that is strong yet relatively light in weight. The portable stage assembly should be storable in a limited area, preferably having a nestable feature to minimize the footprint in the stowed configuration.

Most desirably, the portable stage assembly should be deployable from a stowed configuration to a performance configuration by a single operator. Additionally, it is desirable that the portable stage assembly be variable in height and that the variations be approximately the height of a step such that a number of the individual portable stage assemblies could be grouped in a stepped arrangement. Further, it is desirable that removable safety devices be available to minimize the chances that a performer would fall off the edge of a portable stage assembly.

SUMMARY OF THE INVENTION

The portable stage platform of the present invention substantially meets the aforementioned needs of the industry. The platform is shiftable between a stowed configuration and a performance configuration by a single person. This is facilitated by having a foot-operated locking system that locks the platform in any position. By having a foot-operated locking system, both hands of the operator are free to shift the platform. Shifting of the platform is facilitated by the counterbalancing effect of gas springs. The counterbalancing effect of the gas springs permits even a diminutive individual to readily shift the platform between the stowed configuration and the performance configuration.

The legs of the platform of the present invention are telescoping to provide height increments that are substantially eight inches different in height, the height of a common stair. In production, three different height legs for the platform of the present invention are available, each being adjustable between two different step heights. Accordingly, by selecting appropriate models of the platform of the present invention a total of three different heights can be achieved as desired.

The platform of the present invention is readily transportable, being supported by a frame that has four castors on it when the platform is in the stowed configuration. The frame of the platform is nestable such that two adjoining platforms in the stowed configuration can be nested, each taking only about a foot of width when nested.

Additionally, a readily removable guardrail is provided to provide the additional safety necessary to prevent inadvertent falls from the edge of the platforms. Guardrails of suitable length are provided so that a guardrail may be readily attached to any side of the platform of the present invention.

The portable stage platform of the present invention includes a platform assembly having a mass and being shiftable between a stowed configuration and a performance configuration. The platform assembly has a platform that presents an upwardly directed performance surface when in the performance configuration and an opposed underside. The underside has a plurality of collapsible legs operably coupled thereto. The collapsible legs are shiftable between a collapsed configuration in which the collapsible legs are substantially flush with the underside and an extended configuration in which the collapsible legs are substantially transverse to the underside. The portable stage platform includes a platform base assembly that is shiftable between a stowed configuration and a performance configuration. The platform base assembly has apparatus for counterbalancing the mass of the platform assembly in order to minimize the effort required of an operator to shift the platform assembly between the stowed configuration and a performance configuration.

DETAILED DESCRIPTION OF THE DRAWINGS

Figure 7:
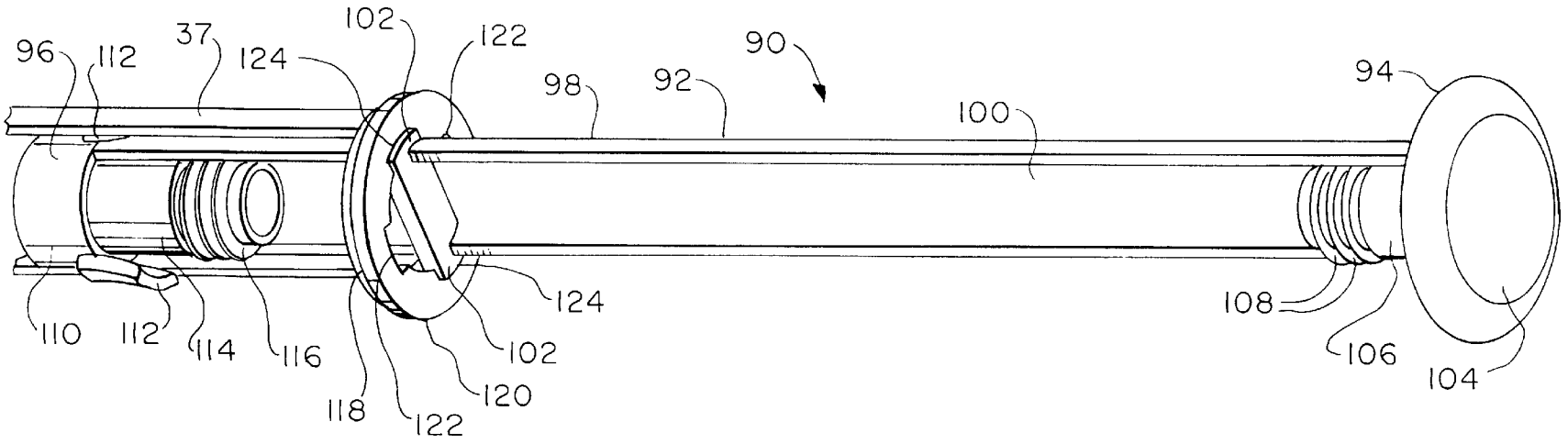
FIG. 7 is a sectional elevational view of a leg of the platform in the extended and locked disposition.
Figure 8B:
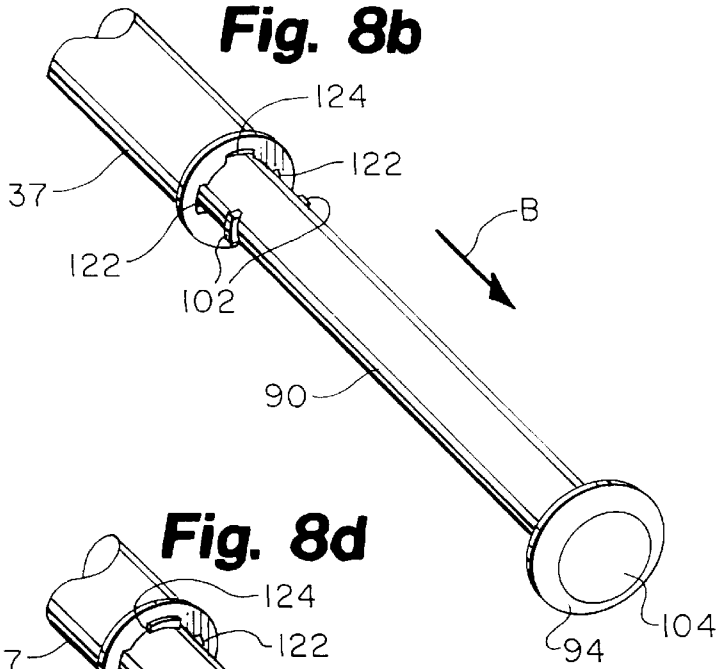
Figure 8D:
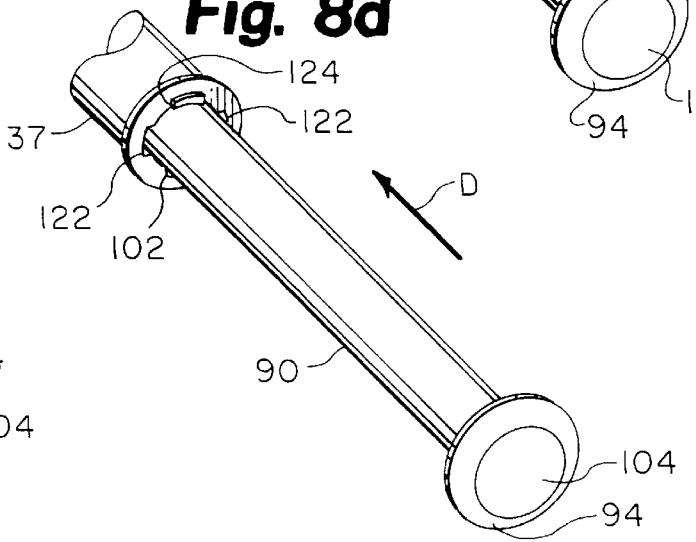
Figure 8A:
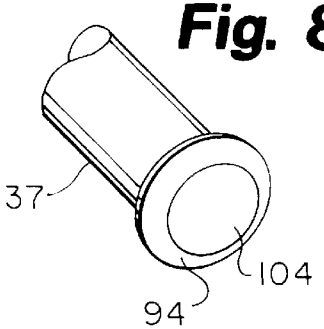
Figure 8C:
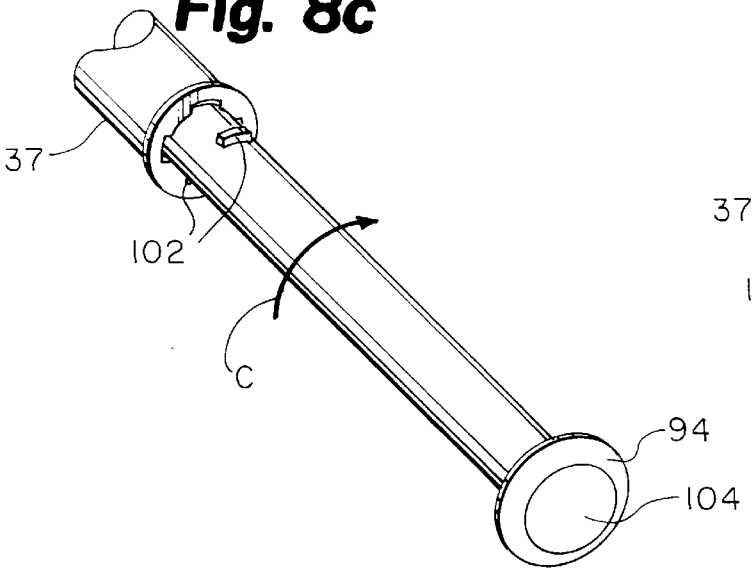
Figure 9:
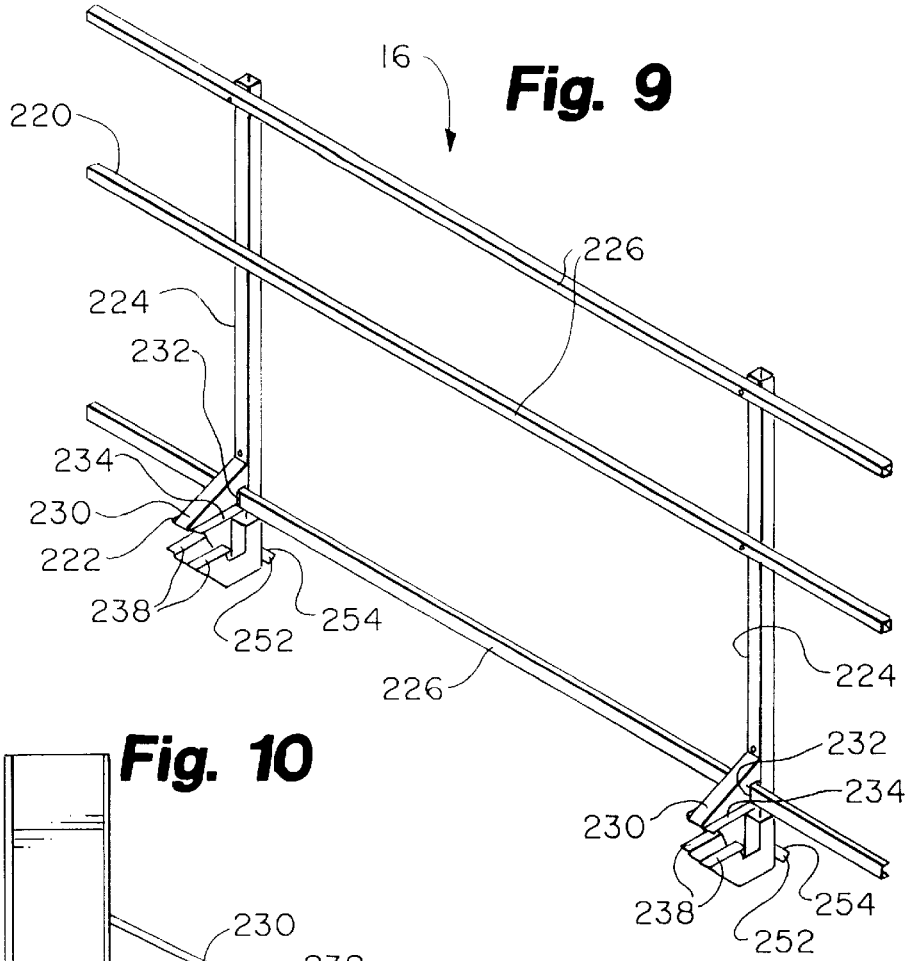
Figure 10:
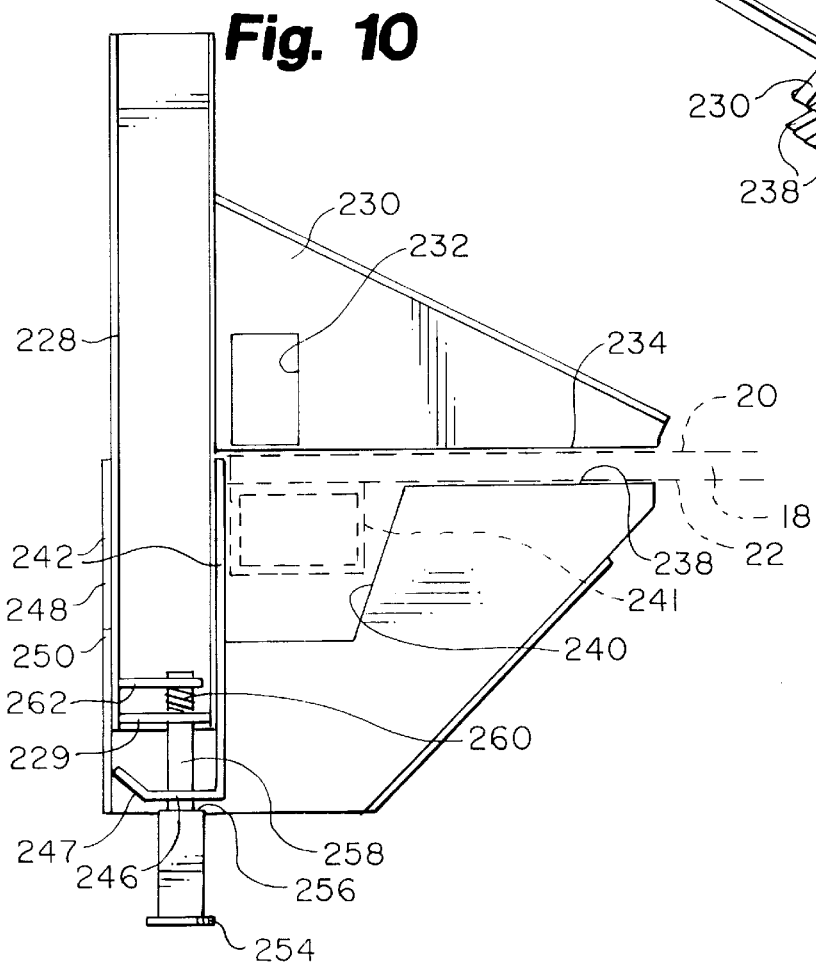
Figure 11:
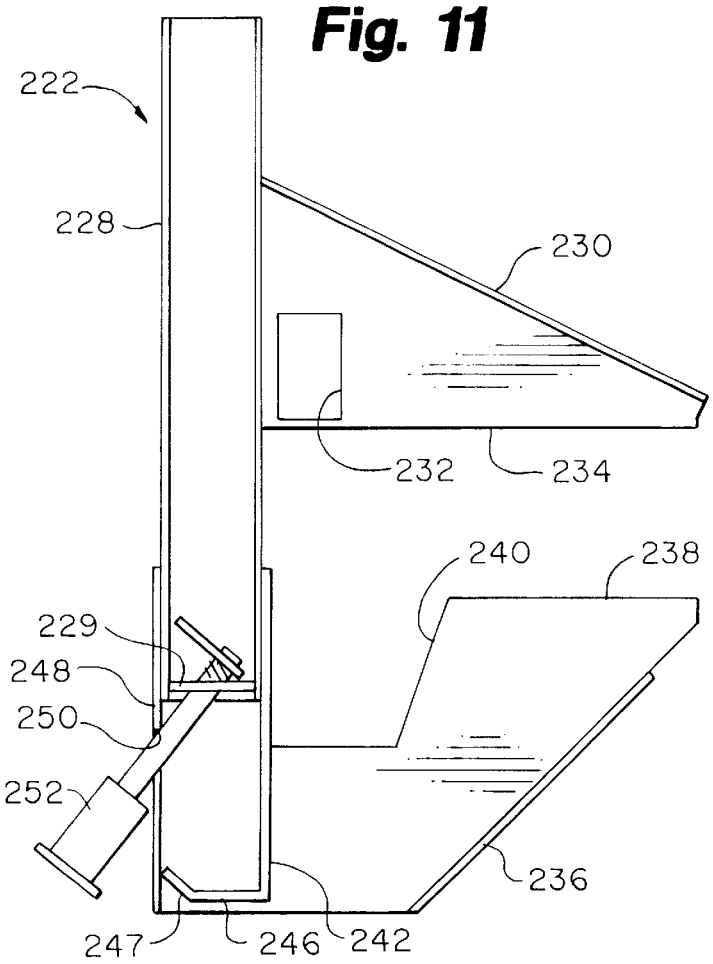
Figure 12:
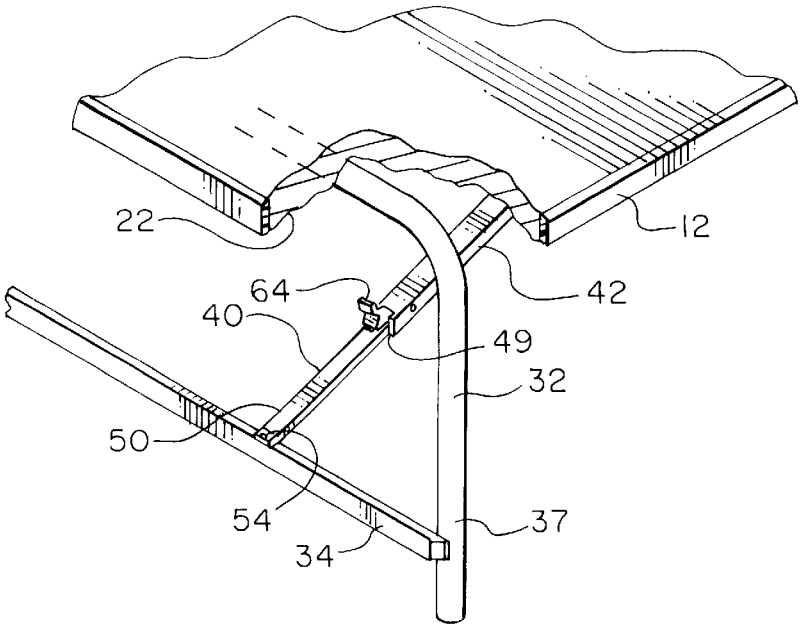
Figure 13:
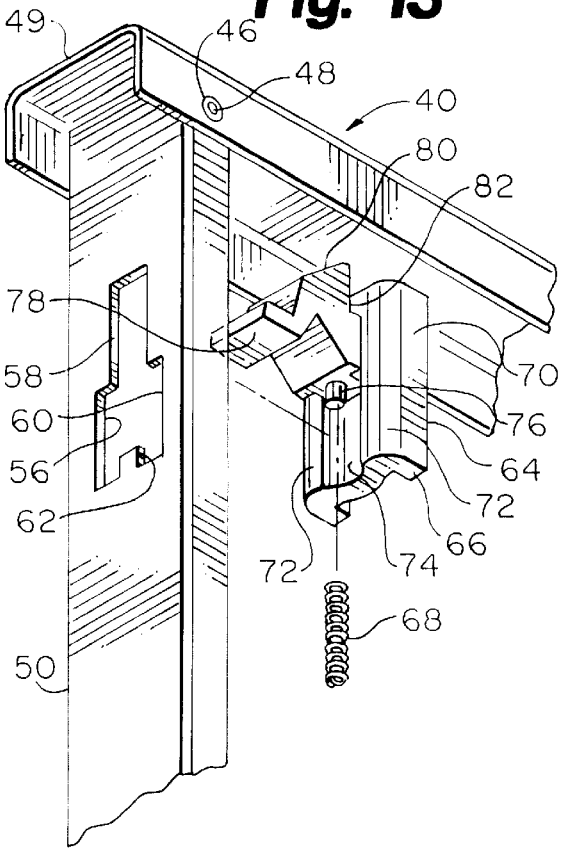
Figure 14:
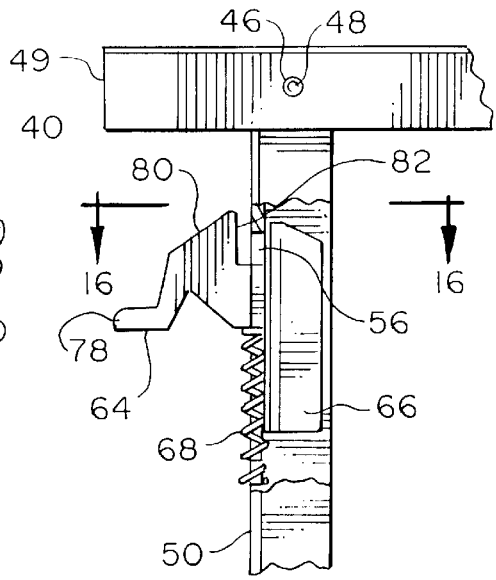
Figure 15:
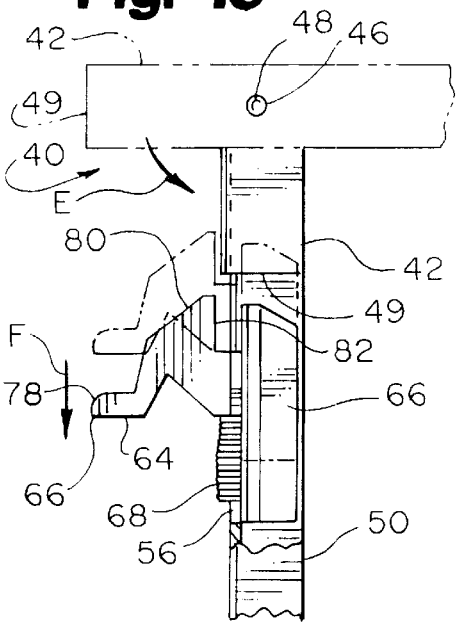
Figure 16:
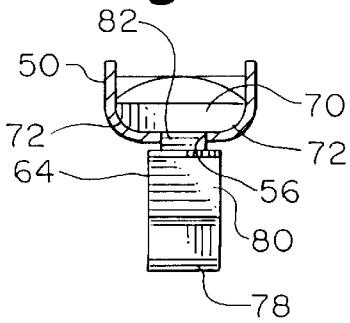

FIG. 8*a* is a perspective view of the telescoping leg of FIG. 7 in the retracted disposition;

FIG. 8*b* is a perspective view of the telescoping leg in the transitional fully extended disposition;

FIG. 8*c* is a perspective view of the telescoping leg of FIG. 8*b* rotated a quarter of a turn to position the lugs over the blind slots;

FIG. 8*d* is a perspective view of the telescoping leg of FIG. 8*c* with the lugs seated in the blind slots;

FIG. 9 is a perspective view of a guardrail of the present invention;

FIG. 10 is a sectional view of the clamp of the guardrail in the locked configuration;

FIG. 11 is a sectional view of the clamp of the guardrail in the unlocked disposition;

FIG. 12 is a perspective view of a portion of the platform broken away to reveal the sidebrace in the locked configuration;

FIG. 13 is a perspective view of the legs of the sidebrace disposed in a transverse relationship with the lock assembly exploded from the lock aperture;

FIG. 14 is a side elevational view of the legs of the sidebrace disposed in a transverse relationship with a portion of a leg broken away to reveal the lock assembly disposed in the lock aperture;

FIG. 15 is a side elevational view of the legs of the sidebrace disposed in a transverse relationship with a portion of a leg broken away to reveal the lock assembly disposed in the lock aperture and indicating the translational motion between the locked and unlocked dispositions of the sidebrace; and FIG. 16 is a sectional view of the lag and the lock assembly taken along the section line 16—16 of FIG. 14.

DETAILED DESCRIPTION OF THE DRAWINGS

The portable stage platform system of the present invention is shown generally at 10 in the figures. The portable stage platform system 10 has three major subcomponents: platform assembly 12 (depicted in FIGS. 1–2, 7, 8*a*–8*d*, 12–16) and platform base assembly 14 (depicted in FIGS. 1–6), and guardrail assembly 16 (depicted in FIGS. 9–11). Generally, the portable stage platform system 10 is shiftable between a stowed configuration depicted in FIG. 1 and a performance configuration depicted in FIG. 2. However, it should be noted that the portable stage platform system 10 is lockable in any intermediate position between the stowed configuration and the performance configuration (with the platform assembly 12 still being rotatable with respect to platform base assembly 14 in the intermediate locked dispositions).

The platform assembly 12 of the portable stage platform system 10 has a platform 18. The platform 18 has a performance surface 20, depicted in FIG. 2, and an opposed underside 22, depicted in FIG. 1. The platform 18 may be formed of wood, metal and plastic materials, as desired, to provide the necessary load bearing capacity for the use to which the portable stage platform system 10 will be put.

The platform 18 has two side margins 24, 26 and an arbitrarily designated front margin 28 and rear margin 30. When the portable stage platform system 10 is in its performance configuration it may be oriented in any suitable manner with respect to the audience and performers such that there is no true front, rear or side of the portable stage platform system 10.

The platform assembly 12 has a plurality of collapsible legs 32 disposed on the underside 22 of the platform 18. The collapsible legs 32 are affixed to the underside 22 by brackets 34. The brackets 34 are held in position by screws 36. The collapsible legs 32 are rotatable within the brackets 34 in order to accommodate folding the collapsible legs 32 flush with the underside 22 as depicted in FIG. 1 and unfolding the collapsible legs 32 as depicted in FIG. 2.

Each of the collapsible legs 32 is generally U-shaped, being formed from a tube that is bent into the U-shape to form the two spaced apart legs 37. A cross brace 34 is preferably welded between the two legs 37 to add strength to the collapsible legs 32.

Figures 1, 2:
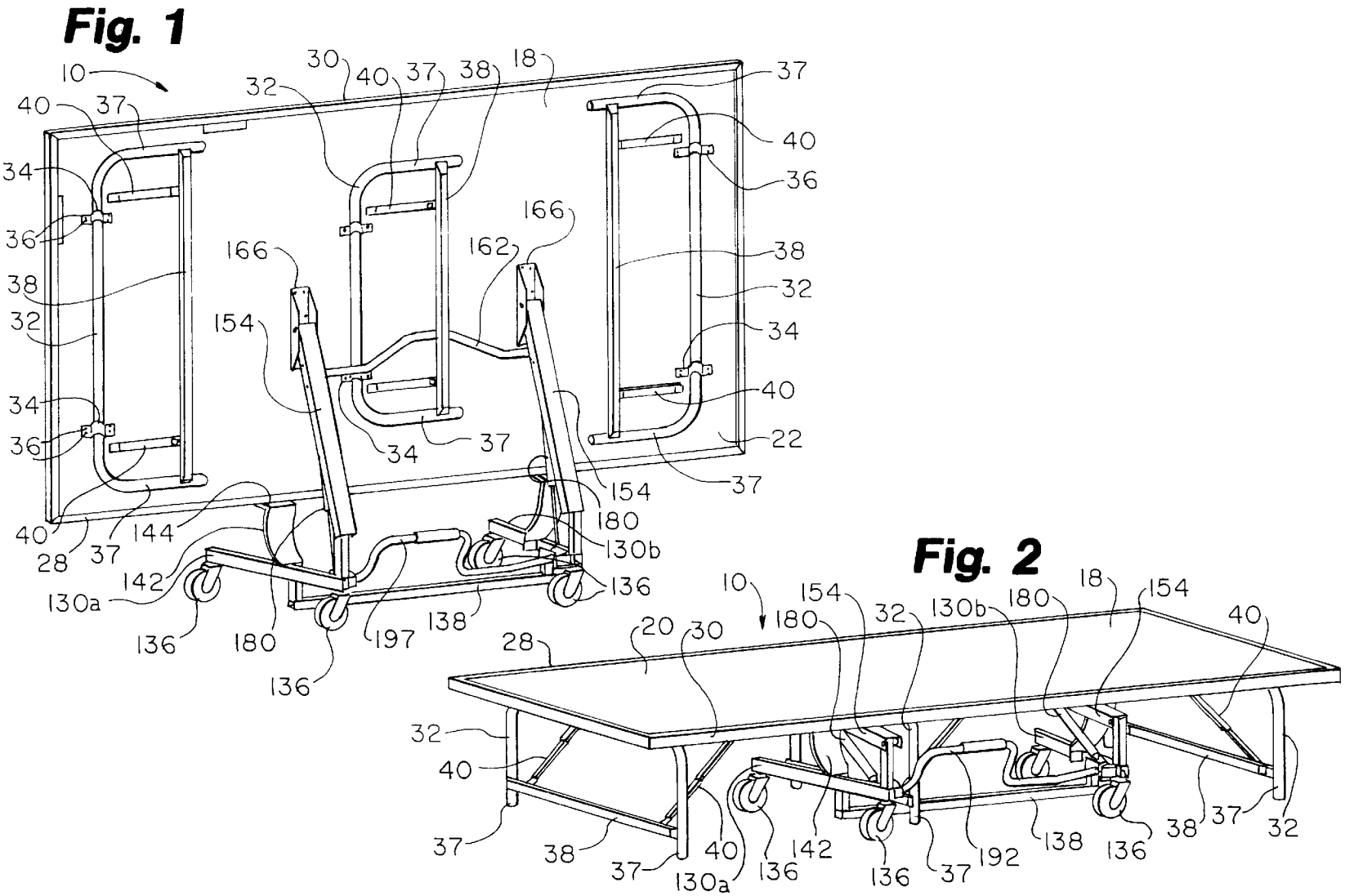
FIG. 1 is a perspective view of the platform of the present invention in the stowed configuration.
FIG. 2 is a perspective view of the platform of FIG. 1 in the performance configuration.

Each of the collapsible legs 32 has a pair of folding sidebraces 40, as depicted in FIGS. 1 and 2. Details of the folding sidebraces 40 are as depicted in FIGS. 12–16. The folding sidebrace 40 has a first leg 42. The first leg 42 is preferably formed of metallic material having a channel shaped cross section. The first leg 42 has a first end having a pivoting coupler 44 that is pivotally coupled to the underside 22 of the platform 18. A pair of pivot bores 46 that are in registry are formed proximate but spaced apart from the edge margin 49 at the second end of the first leg 42.

The second leg 50 of the folding sidebrace 40 is also formed of a channel shaped metallic material. The second leg 50 is selected such that is it small enough to rest within the channel of the first leg 42 when the folding sidebrace is in the folded configuration depicted in FIG. 1.

A pair of pivot bores 52 that are in registry are formed proximate a first end of the second leg 50. The pivot bores 52 and the pivot bores 46 are brought into registry and a pivot pin 48 is utilized to pivotally couple the first leg 42 and the second leg 50. The second end of the second leg 50 is pivotally coupled to the cross brace 32 by a pivoting coupler 54.

Referring to FIG. 16, a lock aperture 56 is defined in the second leg 50 proximate the pivot bores 52. The lock aperture 56 has a relatively slender slide aperture portion 58 coupled to a wider insertion aperture portion 60. A small spring retainer tab 62 is formed opposite the slide aperture portion 58.

A lock assembly 64 is designed to be inserted into the insertion aperture portion 60 of the lock aperture 56. After insertion, the lock assembly 64 is rotated and is then positioned to be longitudinally slidable within the slide aperture portion 58.

The lock assembly 64 has two major subcomponents: lock 66 and spring 68. The lock 66 is preferably made of a relatively hard plastic material such as nylon. The lock 66 has a slide 70. The slide 70 has beveled faces 72 that accommodate the lock 66 sliding within the channel shaped second leg 50. A spring groove 74 is defined in the lock 66. A small spring retaining post 76 is provided at an end of the spring group 74. The spring retainer post 76 projects into the spring groove 74.

A thumb release 78 is disposed substantially transverse to the longitudinal axis of the spring groove 74. The thumb release 78 is adapted for actuation by an individual to unlock the lock 66, thereby freeing the first leg 42 and the second leg 50 to pivot with respect to one another.

A beveled face 80 is disposed forward of the thumb release 78. The beveled face 80 overlies a locking groove 82 that is defined between the beveled face 80 and the slide 70 of the lock 66. The depth of the locking groove 82 is such that when in a locked configuration, the locking groove 82 overlies both the edge margin 49 of the first leg 42 and a portion of the second leg 50, thereby locking the first leg 42 to the second leg 50.

The spring 68 is preferably a coil spring and is disposed within the spring groove 74. The spring 68 is held in position by the spring retainer tab 62 at one end of the spring 68 and by the spring retaining post 76 at the second end of the spring 68. In such position, the spring 68 biases the lock 66 into the locked disposition, as previously described.

As previously indicated, it is desirable that the portable stage platform system 10 be adjustable in height.

Accordingly, each of the legs 37 of the collapsible legs 32 has an extendible leg 90 telescopically disposed therein. Referring to FIGS. 7 and 8*a*–8*d*, the extendible leg 90 has a generally tubular body 92. The tubular body 92 is preferably made of a metal and has an outside diameter that is slightly less than the inside diameter of the leg 37. Accordingly, the extendible leg 90 is free to translate longitudinally within the leg 37. In a preferred embodiment, the extendible leg 90 adds approximately eight inches to the height of the portable stage platform system 10 when the extendible leg 90 is in the extended disposition. Such height is approximately the height of a normal step in a stairway.

The extendible leg 90 has a foot 94 disposed at the exposed end of the extendible leg 90 and retainer 96 that is disposed at the end of the extendible leg 90 that is inserted within the leg 37. The extendible leg 90 has an exterior surface 98 and an interior bore 100 defined therein. A pair of opposed lugs 102 project substantially transversely to the longitudinal axis of the extendible leg 90.

The foot 94 of the extendible leg 90 is preferably made of a plastic material in order to minimize marring of the floor surface on which the portable stage platform system 10 is disposed. The foot 94 has a ground engaging surface 104 and a shank 106 that is disposed within the interior bore 100. A plurality of ribs 108 provide for a compressive engagement of the shank 106 with the interior bore 100, thereby holding the foot 94 in place.

The retainer 96 is preferably formed of a material similar to that of the foot 94. The retainer 96 has a cap 110. Two opposed retainer tabs 112 are formed integral with the cap 110. The opposed retainer tabs 112 have an outwardly directed bias such that the retainer tabs 112 are held in compressive engagement with the inside surface of the leg 37. The retainer 96 has a shank 114 formed integral with the cap 110. The shank 114 has ribs 116 formed thereon that are held in compressive engagement with the interior bore 100 of the extendible leg 90.

The leg 37 has two disks 118, 120 that are preferably coupled thereto by weldments. A pair of opposed through-slots 122 are formed in registry in both disk 118 and disk 120. A pair of opposed blind slots 124 are formed only in the disk 120.

The platform base assembly 14 of the portable stage platform system 10 is shown in FIGS. 1 and 2 with particular details in FIGS. 3–6. The platform base assembly 14 has two axles 130*a*, 130*b*. The axles 130*a*, 130*b* are preferably formed of box section metal material. Preferably, the axles 130*a*, 130*b* are set in a trapezoidal relationship to each other such that the open ends 132*a*, 132*b* are further apart than the closed ends 134*a*, 134*b*. The open ends 132*a*, 132*b* define an opening therebetween that opens into the trapezoidal space defined between the axles 130*a*, 130*b*. The trapezoidal relationship of the axles 130*a*, 130*b* facilitates nesting of the portable stage platform system 10 when the portable stage platform system 10 is in its stowed configuration, as will be described.

A castor 136 is disposed at each of the ends 132*a*, 132*b*, 134*a*, 134*b*, of the axles 130*a*, 130*b*. The castors 136 permit the portable stage platform system 10 to be rolled across a supporting floor surface in any configuration of the portable stage platform system 10 other than the performance configuration, the ground engaging surface 104 of the extendible legs 90 being in contact with the floor surface on which the portable stage platform system 10 is resting in the performance configuration.

A cross brace 138 extends between the two axles 130*a*, 130*b* and is supported by a pair of uprights 140. The uprights 140 are welded to the cross brace 138 and to the axles 130*a*, 130*b*, respectively. An edge support 142 extends upwardly from the uprights 140. The edge support 142 has a platform support 144 at its upper margin, and a retainer lip 146 that is disposed at the side of the platform support 144 closest to the open ends 132*a*, 132*b* of the axles 130*a*, 130*b*. When in the stowed configuration depicted in FIG. 1, the front margin 28 of the platform 18 is supported by the platform support 144 and the platform 18 is supported in an erect, substantially vertical disposition.

A shiftable platform support 150 is supported on two upright standards 152. The upright standards 152 extend upward from the closed ends 134*a*, 134*b* of the axles 130*a*, 130*b*. The shiftable platform support 150 includes two generally parallel support arms 154. The support arms 154 are supported at a first end by the upright standard 152. Pivot bores 156 formed in the parallel support arms 154 are in registry with pivot bores (not shown) formed in the upright standard 152. The support arms 154 are offset with respect to the upright standards 152 and accordingly a spacer 158 is disposed in registry with the pivot bores 156. A pivot pin 160 is utilized to pivotally secure the support arms 154 to the upright standards 152.

A cross brace 162 extends between the two parallel support arms 154 and is mounted on cross brace mounts 164 that depend from the parallel support arms 154. A pivoting platform support 166 is mounted proximate the second end of each of the support arms 154. The platform support 166 is pivotally mounted to the support arms 154 by a pivot pin 170 disposed within pivot bores 168 formed in the platform support and similar bores (not shown) formed in the support arms 154. A plurality of screw bores 172 are formed in the platform supports 166 to facilitate affixing the underside 22 of the platform 18 to the platform supports 166 by means of screws (not shown).

Lockable gas springs 180 are utilized to counterbalance the mass of the platform 18 mounted on the platform base assembly 14. Such counterbalancing facilitates shifting of the portable stage platform system 10 from the stowed configuration to the performance configuration with a minimum of effort by a single operator.

Figure 5:
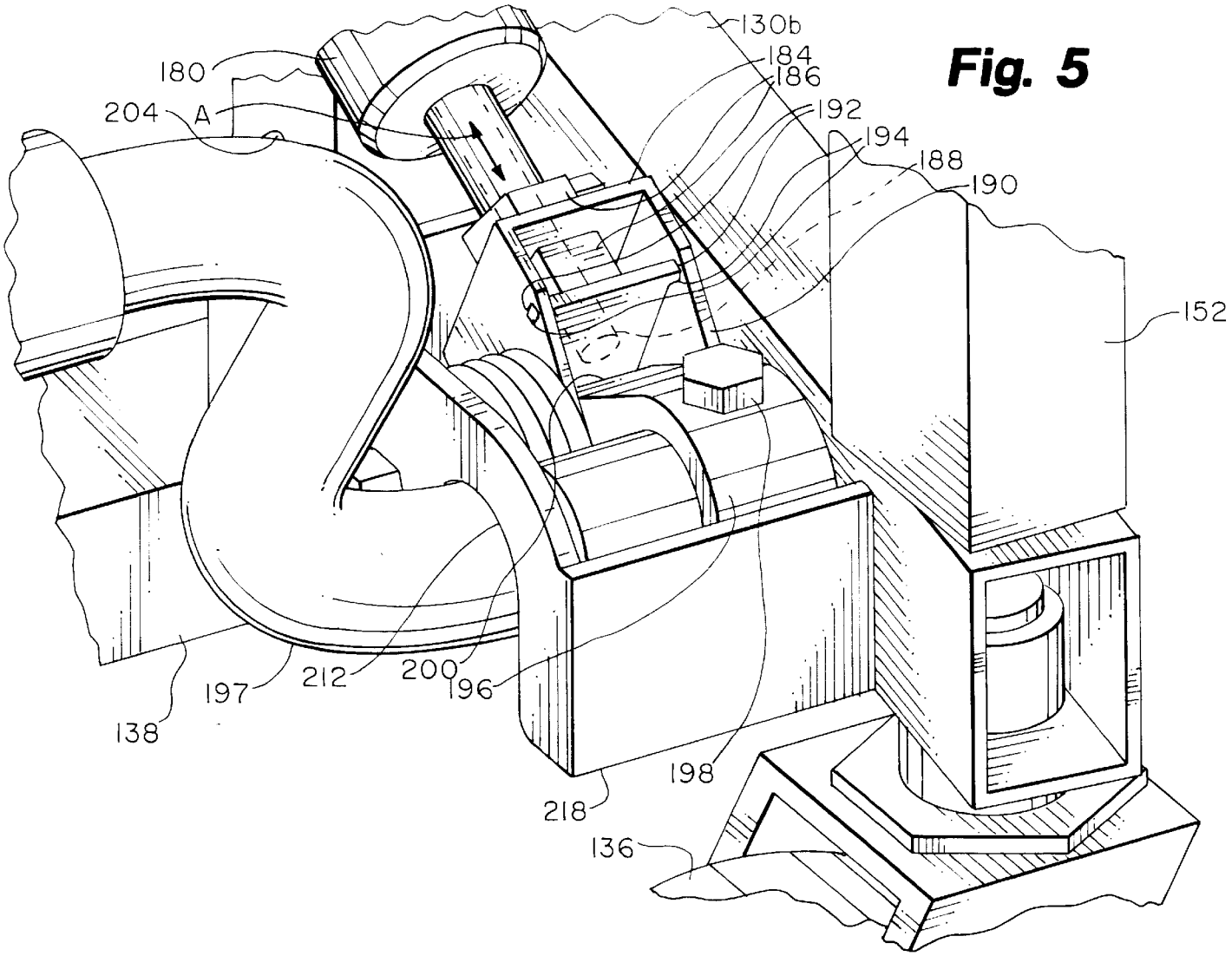
FIG. 5 is a perspective view of the gas spring locking mechanism in the lock configuration.
Figure 6:
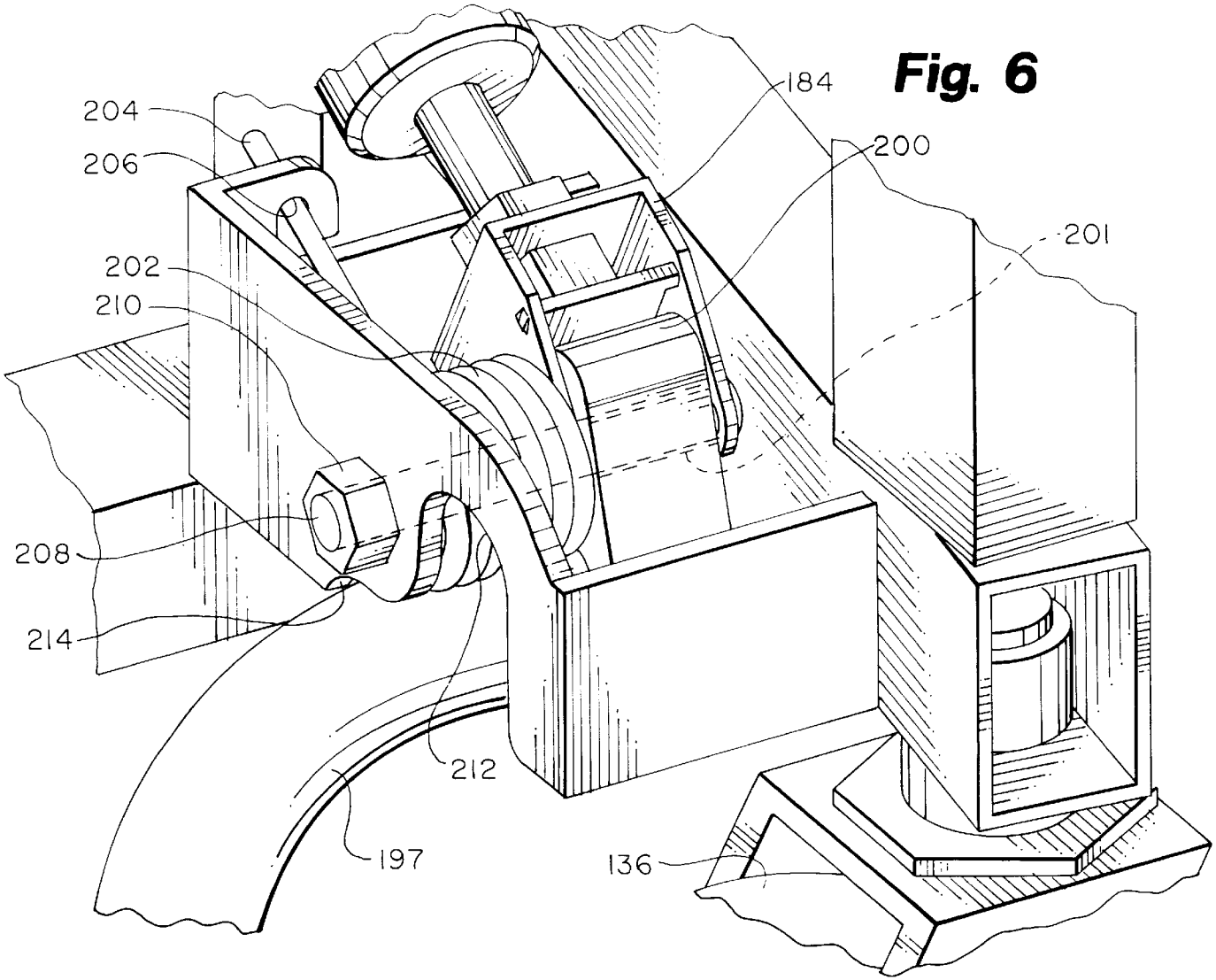
FIG. 6 is a perspective view of the gas spring locking mechanism in the unlock configuration.

The lockable gas springs 180 are pivotally affixed to the parallel support arms 154 at a first end by a pin (not shown) disposed in the pin bores 182 and a similar bore defined in the end of the lockable gas springs 180. The second end of the lockable gas springs 180 is affixed to a spring bracket 184 by lock nuts 186, as best seen in FIGS. 5 and 6. When unlocked, the gas springs 180 tend to extend and thereby act to rotate the parallel support arms 154 in an arc about the pivot bores 156. Such motion exerts a generally lifting force on the platform assembly 12.

Referring again to FIGS. 5 and 6, a concentric lock release 188 is disposed within the lockable gas spring 180. The concentric lock release is translatable within the lockable gas springs 180 as indicated by arrow A. FIG. 5 depicts the concentric lock release 188 in its extended, locked disposition. In such disposition, the gas spring 180 is locked at its present length and acts as a fixed length link of a linkage system. Accordingly, the parallel support arm 154 that is coupled to the gas spring 180 is also set in its present disposition when the gas spring 180 is locked.

A hinged actuator 190 is disposed in relationship to the concentric lock release 188 to bear upon the end of the concentric lock release 188. The hinged actuator 190 is supported by hinge tabs 192 disposed in hinge apertures 194 defined in the spring bracket 184.

Figure 3:
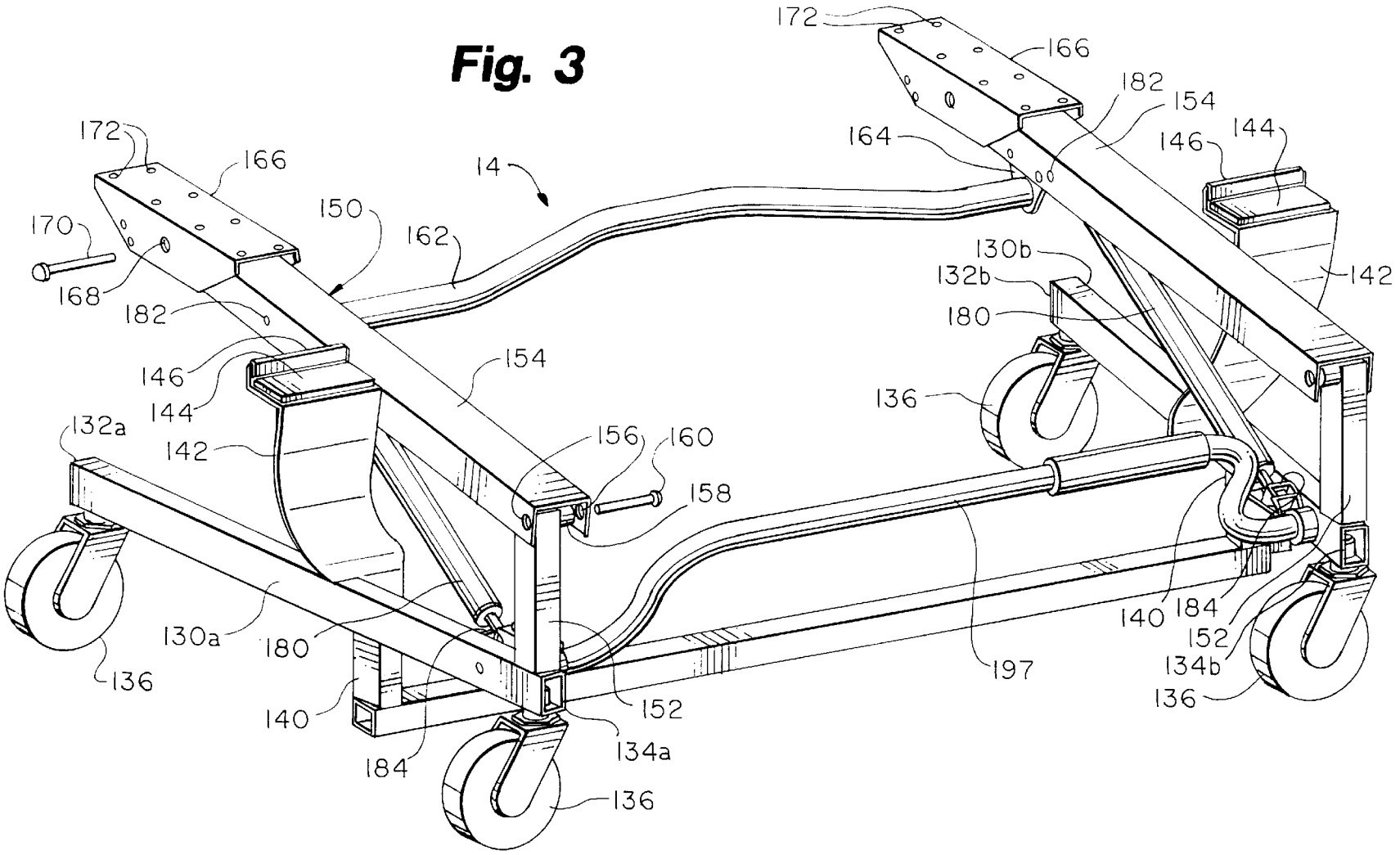
FIG. 3 is a perspective view of the base of the platform in the performance configuration with the foot lock in the locked disposition.
Figure 4:
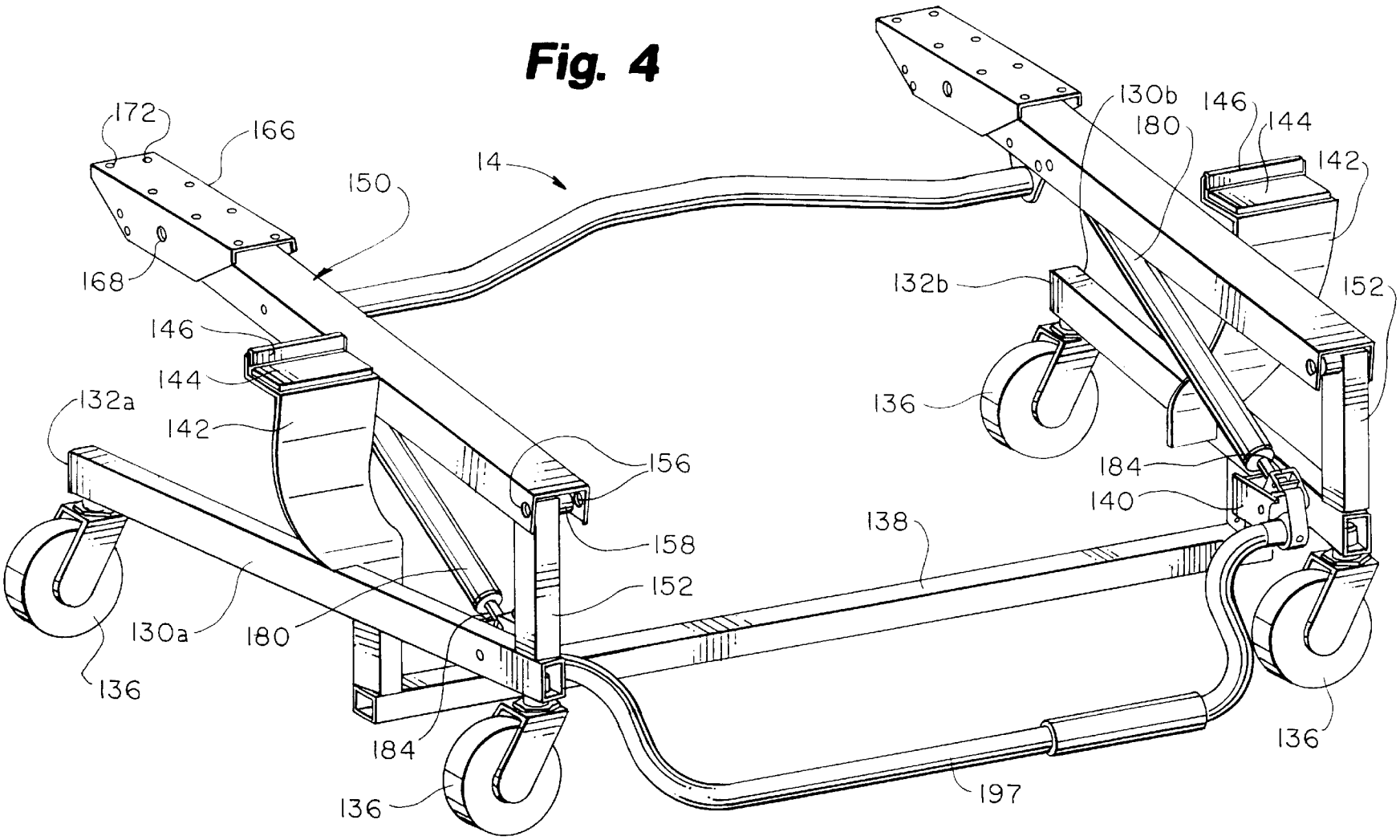
FIG. 4 is a perspective view of the base of the platform in the performance configuration with the foot lock in the unlocked position.

A cam 196 is disposed on each end of the foot lock 197 and is held in the desired relationship thereto by the lock bolt 198. The cam 196 has a cam face 200 that is designed to bear upon the hinged actuator 190. It should be noted that the depiction of FIG. 5 corresponds to the configuration of the platform base assembly 14 as depicted in FIG. 3 while the depiction of FIG. 6 corresponds to the depiction of the platform base assembly 14 as depicted in FIG. 4. FIGS. 3 and 5 depict the lockable gas springs 180 in the locked configuration. FIGS. 4 and 6 depict the lockable gas springs 180 in the unlocked configuration. FIGS. 5 and 6 depict the detail of the locking features of the lockable gas springs 180 that are disposed at the right hand side of the platform base assembly 14 as depicted in FIGS. 3 and 4. It is understood that there is similar locking features of the locking gas spring 180 disposed at the left hand side of the platform base assembly 14 as depicted in FIGS. 3 and 4.

A mounting bracket 218 is welded to the axles 130*a*, 130*b*, respectively. The mounting bracket 218 has a pivot bolt 208 that is held in position by a nut 210. The pivot bolt 208 couples a number of items to the bracket 218, as will be described. First, the bolt 208 has a spring 202 concentrically mounted thereon. Further, the pivot bolt 208 pivotally mounts the spring bracket 184 to the mounting bracket 218. Additionally, the pivot bolt 208 pivotally supports the cam 196 by means of a bore 201 defined therein.

The mounting bracket 218 has a first foot lock stop 212, depicted in FIGS. 5 and 6 and a second foot lock stop 214 depicted in FIG. 6, corresponding to the locked position of the concentric lock release 188 and the unlocked disposition of the concentric lock release 188, respectively.

The spring 202 is preferably a coil spring having two ends. The first spring end 204 is captured in a retainer 206 defined in the mounting bracket 218. The second end (not shown) of the spring 202 underlies the foot lock 197 and acts to bias the foot lock 197 into the first foot lock stop 212, which in turn biases the concentric lock release 188 into the locked disposition.

Moving the foot lock 197 from the disposition depicted in FIG. 5 to the disposition depicted in FIG. 6 acts to increase the tension in the spring 202. Additionally, such motion rotates the cam 196, thereby bringing the cam face 200 into compressive engagement with the hinged actuator 190. The hinged actuator 190 bears upon the end of the concentric lock release 188, forcing the concentric lock release 188 into its retracted, unlocked disposition. In the unlocked disposition, the lockable gas springs 180 are free to extend under the influence of the internal bias of the gas springs 180 or be retracted responsive to a user positioning the platform 18 as desired.

When pressure on the foot lock 197 is released, the spring 202 acts to rotate the foot lock 197 from the position depicted in FIG. 6 to the position depicted in FIG. 5. This rotation causes the cam face 200 to disengage from the hinged actuator 190, thereby allowing the concentric lock release 188 to extend and to thereby lock the lockable gas spring 180 in its present disposition.

Turning now to FIGS. 9–11, at least one guardrail assembly 16 may be provided with the portable stage platform system 10. The guardrail assembly 16 has two subcomponents: guardrail 220 and at least two clamps 222.

The guardrail 220 includes at least two upright standards 224. A plurality of cross bars 226 extend between the upright standards 224. It is understood that, where needed, a plurality of auxiliary upright bars can be extended between the cross bars 226. These auxiliary upright bars can be placed close enough together to meet the requirements of a child-proof device. In this case, middle cross bar 226 is preferably lowered to a disposition proximate the clamps 222. End pieces that extend the length of the guard rail 220 may be attached to the guardrails 220 on two adjoining sides of the portable stage platform system 10 in order to effect a joint at the corner in order to prevent a child from squeezing through a space left between the guardrails 220 at the corner.

The clamp 222 includes an upright standard support 228. In use, the upright standard 224 may be slipped over the standard support 228 or slipped into the standard support 228. Additionally, the standard support 228 may be formed integral with the upright standard 224. The standard support 228 has a slotted box end 229.

An upper jaw 230 is affixed to the standard support 228 as by weldments. The upper jaw 230 has a cross bar support aperture 232 defined therein. The cross bar support aperture 232 is designed to fit over and support the lower cross bar 226. The upper jaw 230 has a clamp surface 234. The clamp surface 234 is designed to compressively engage the performance surface 20 of the platform 18.

A lower jaw 236 is slidably coupled to the standard support 228. The lower jaw 236 has an upward directed clamp surface 238. The clamp surface 238 is designed to compressively engage the underside 22 of the platform 18. A cutout 240 is provided in the lower jaw 236 in order to accommodate a perimeter strengthening member 241 disposed on the underside 222 of the platform 18.

A box member 242 is slid over the exterior of the standard support 228. The box member 242 has a slotted foot 246. The slot opens to the left as depicted in FIGS. 10 and 11. The slotted foot 246 has a beveled face 247. The slotted side 248 of the box member 242 has a slot 250 defined therein. The slot 250 is open at the bottom of the slotted side 248 and extends upwardly therefrom.

A screw jack 252 is utilized to bring the lower jaw 236 into compressive engagement with the platform 18. The screw jack 252 has tabs 254 that provide an engaging surface to permit the screw jack 252 to be digitally rotated. An upwardly directed bearing surface 256 is formed adjacent to the shank 258. The shank 258 has threads 260 defined in the upper portion thereof. The shank 258 is threadedly engaged with the threaded bore (not shown) defined in the bearing plate 262. It should be noted that the bearing plate 262 has substantially smaller dimensions than the inside dimensions of the standard support 228.

In the engaged disposition depicted in FIG. 10, the guardrail assembly 16 is rested on the performance surface 20 of the platform 18. The lower jaw 236 is slid upward on the standard support 228 until the clamp surface 238 comes into engagement with the underside 222 of the platform 18. The screw jack 252 is then rotated. The bearing plate 262 is of such a size that it is restrained from rotating within the standard support 228. Accordingly, the bearing plate 262 is brought down into compressive engagement with the box end 229 while the bearing surface 256 is brought into compressive engagement with the slotted foot 246. Such compressive engagements hold the lower jaw 236 in compressive engagement with the platform 18, thereby supporting the guardrail assembly 16 on the edge of the platform 18.

Referring to FIG. 11, the guardrail assembly 16 is disengaged from the platform 18 by threading the screw jack 252 in the opposite direction as previously described in order to loosen the screw jack 252. Once the screw jack 252 is loose with both the bearing surface 256 and the bearing plate 262 disengaged from compressive engagement, the screw jack 252 can be rotated out of the slot defined in the slotted foot 246 and into the slot 250 defined in the slotted side 248. Such rotation permits the lower jaw 236 to drop down, clearing both the platform 18 and any perimeter support 241 affixed thereto. The guardrail assembly 16 may be then removed from the platform assembly 12.

In operation, the portable stage platform system 10 in the stowed configuration as depicted in FIG. 1 may be nested with adjacent portable stage platform systems 10 by encompassing the platform base assembly 14 of a first portable stage platform system 10 within the trapezoidally disposed axles 130*a*, 130*b* of a second portable stage platform system 10. In this manner, only a foot of lateral space is required to store each of a plurality of portable stage platform systems 10 in a nested, stowed configuration.

To reconfigure the portable stage platform system from the stowed configuration of FIG. 1 to the performance configuration of FIG. 2, the portable stage platform system 10 is rolled to a suitable position on the stage floor. While the portable stage platform system 10 is in its stowed configuration, the collapsible legs 32 are rotated from the folded configuration depicted in FIG. 1 to the unfolded configuration depicted in FIG. 2. Grasping a leg 37 and rotating the leg 37 through a 90° arc puts the collapsible legs 32 into the unfolded configuration. This motion acts to lock the sidebraces 40 that support the collapsible legs 32.

The locking action of the sidebraces 40 may be determined with respect to FIG. 15, As indicated by arrow E in FIG. 15, the first leg 42 of the sidebrace 40 rotates from the position indicated in phantom in FIG. 15 to the position indicated by solid lines in FIG. 15. As the collapsible legs 32 approach the unfolded configuration depicted in FIG. 1, the edge margin 49 of the first leg 42 of the folding sidebrace 40 bears on the beveled face 80 of the lock 66. As indicated by the arrow F, the pressure exerted by the edge margin 49 forces the lock 66 to retreat from the locked configuration (depicted in phantom in FIG. 15) to the unlocked configuration (depicted in solid lines in FIG. 15) against the bias of the spring 68.

As the edge margin 49 slips over the edge of the beveled face 80, the spring 68 forces the lock 66 to advance to the locked configuration (depicted in phantom in FIG. 15) and the first leg 42 is captured within the locking groove 82 of the lock 66 (as depicted by the solid lines in FIG. 15), thereby locking the folding sidebrace 40.

A single operator then depresses the foot lock 197, thereby rotating the foot lock 197 from the locked configuration depicted in FIGS. 3 and 5 to the unlocked configuration depicted in FIGS. 4 and 6. Such action unlocks the two lockable gas springs 180. The lockable gas springs 180 then tend to exert an upward force on the platform assembly 12. The operator assists in raising the platform assembly 12 sufficiently to permit the front margin 28 of the platform 18 to clear the retainer lip 146 of the leg support 142. Once cleared, the platform 18 is rotated to the position depicted in FIG. 2. A gentle pressure on the performance surface 20 overcomes the counterbalancing force of the lockable gas springs 180 and puts the legs 37 into contact with the supporting stage. At this point, the foot lock 197 can be released and the lockable gas springs are then returned to their locked configuration.

Referring to FIGS. 8*a*–8*d*, the height of the portable stage platform system 10 may be adjusted by extending the extendible legs 90. To accomplish this, the foot 94 is grasped and pulled outward against the compressive force exerted by the opposed retainer tabs 112. The opposed lugs 102 are aligned with the through slots 122 and pulled beyond the disks 118, 120. At this point the opposed retainer tabs 112 will engage the inner surface of the disk 118, thereby preventing the extendible leg 90 from being pulled completely free of the leg 37. Such extension is as indicated by arrow B and FIG. 8*b*.

Referring now to FIG. 8*c*, the extendible leg 90 is rotated one quarter turn as indicated by arrow C to align the opposed lugs 102 with the blind slots 124 defined in the disk 120.

Referring to FIG. 8*d*, the extendible leg 90 is then pushed inward as indicated by arrow D until the opposed lugs 102 are seated within the blind slots 124. A disposition of the extendible leg 90 with respect to the leg 37 as depicted in FIG. 8*d* provides for an increase in height of the portable stage platform system 10 of approximately eight inches. Retraction of the extendible legs 90 is exactly the opposite of the aforementioned procedure with respect to FIGS. 8*a*–8*d*.

After use of the portable stage platform system 10, the portable stage platform system 10 may be reconfigured in the stowed configuration. The actions to accomplish this are essentially opposite the aforementioned actions to put the portable stage platform system 10 in the performance configuration. The operator again depresses the foot lock 197 to unlock the gas springs 180. The platform assembly 12 is then raised with the assistance of the two lockable gas springs 180. The platform assembly 12 is then rotated through approximately 90 degrees and is rested on the edge support 142 of the support platform 144. The operator then releases the foot lock 197 to again lock the gas springs 180.

Returning the collapsible legs 32 to the folded configuration requires an operator to grasp the thumb release 78 of the lock 66 and cause the lock 66 to retreat against the bias of the spring 68, as indicated by arrow F of FIG. 15. Once the locking groove 82 of the lock 66 is free of the end margin 49, the first leg 42 and second leg 50 of the folding sidebrace 40 may be pivoted with respect to one another and the collapsible legs 32 may be collapsed to the folded configuration as depicted in FIG. 1.

The first portable stage platform system 10 may then be rolled on the castors 136 to a suitable storage area. The first portable stage platform system 10 is then nested with an adjacent (already stored) second portable stage platform system 10 by sliding the open end 132*a*, 132*b* of the trapezoidal axles 130*a*, 130*b* respectively to encompass the trapezoidal axles 130*a*, 130*b* of the adjacent second portable stage platform system 10 in the opening defined between the trapezoidal axles 130*a*, 130*b* of the first portable stage platform system 10 commencing at the closed ends 134*a*, 134*b* of the trapezoidal axles 130*a*, 130*b* of the adjacent second portable stage platform system 10. A third portable stage platform system 10 may then be nested with the first and second portable stage platform systems 10 in a similar manner. Such nesting requires only a foot of lateral storage space to accommodate each nested portable stage platform system 10.

While the preferred embodiment of the present invention has been illustrated and described herein, it is to be understood that the invention is not limited to the precise construction so illustrated and described. Accordingly, it is intended that the scope of the present invention be dictated by the scope of the appended claims and not by the description of the preferred embodiment.

What is claimed is:

1. A portable stage platform, comprising;

a platform assembly having a mass and being shiftable between a stowed configuration and a performance configuration, having a unitary platform presenting an upwardly directed performance surface when in the performance configuration and an opposed underside, the underside having a plurality of collapsible legs operably coupled thereto, the collapsible legs being shiftable between a collapsed configuration substantially flush with the underside and an extended configuration substantially transverse to the underside; and a platform base assembly operably coupled to the platform assembly, the platform base assembly being shiftable between a stowed configuration and a performance configuration and having means for counterbalancing the mass of the platform assembly to minimize the effort required of an operator to shift the platform assembly between the stowed configuration and a performance configuration.

2. A portable stage platform, comprising;

a platform assembly having a mass and being shiftable between a stowed configuration and a performance configuration, having a unitary platform presenting an upwardly directed performance surface when in the performance configuration and an opposed underside, the underside having a plurality of collapsible legs operably coupled thereto, the collapsible legs being shiftable between a collapsed configuration substantially flush with the underside and an extended configuration substantially transverse to the underside; and a platform base assembly operably coupled to the platform assembly, the platform base assembly being shiftable between a stowed configuration and a performance configuration and having means for counterbalancing the mass of the platform assembly to minimize the effort required of an operator to shift the platform assembly between the stowed configuration and a performance configuration, the means for counterbalancing the mass of the platform assembly being extendable and being lockable in any partially extended disposition between an extended disposition and a retracted disposition.

3. The portable stage platform of claim 2 further including means for selectively locking and unlocking the means for counterbalancing the mass of the platform assembly.

4. The portable stage platform of claim 3 further wherein the means for selectively locking and unlocking the means for counterbalancing the mass of the platform assembly is foot operable by an operator.

5. The portable stage platform of claim 4 further wherein the means for counterbalancing the mass of the platform assembly is a plurality of gas springs.

6. The portable stage platform of claim 5 further wherein each gas spring of the plurality of gas springs has a first end operably coupled to a support arm, the support arm being operably pivotally coupled at a support arm first end to the platform assembly.

7. The portable stage platform of claim 6 further wherein the support is pivotally coupled at a support arm second end to a portion of the platform base assembly, extension of the plurality of gas springs acting to pivot the support arm in an arc about the support arm second end.

8. The portable stage platform of claim 1 wherein the platform base assembly includes two spaced apart axles, the axles defining a trapezoidal space therebetween and presenting an outwardly directed opening for receiving the axles of an adjacent portable stage platform when the portable stage platform and the adjacent portable stage platform are in a nested relationship.

9. The portable stage platform of claim 1 further including means for guarding against a fall from the platform when the portable stage platform is in the performance configuration, said means being selectively, removably deployable along at least one edge margin of the platform of the platform assembly.

10. A portable stage platform, comprising;

a platform assembly having a mass and being shiftable between a stowed configuration and a performance configuration, having a unitary platform presenting an upwardly directed performance surface when in the performance configuration and an opposed underside, the underside having a plurality of collapsible legs operably coupled thereto, the collapsible legs being shiftable between a collapsed configuration substantially flush with the underside and an extended configuration substantially transverse to the underside;

a platform base assembly operably coupled to the platform assembly, the platform base assembly being shiftable between a stowed configuration and a performance configuration and having means for counterbalancing the mass of the platform assembly to minimize the effort required of an operator to shift the platform assembly between the stowed configuration and a performance configuration; and means for guarding against a fall from the platform comprising a guard rail assembly, the guard rail assembly having a guard rail, the guard rail having at least two upright standards, a clamp being operably coupled to each of the at least two upright standards, the clamps for removably affixing the guard rail assembly to a selected edge margin of the platform, each of the clamps having two opposed jaws, a first jaw being translatable with respect to a second jaw, a screw jack being operably coupled to the first jaw and the second jaw to effect the translation of the first jaw with respect to a second jaw, the screw jack being pivotally coupled at a coupling to the second jaw, a slot being defined in a side of the first jaw, the screw jack being pivotable in an arc about the coupling to the second jaw, motion of the screw jack in said arc bringing a portion of the screw jack into the slot defined in a side of the first jaw to facilitate an enhanced translation of the first jaw with respect to the second jaw.

11. A portable stage platform, comprising;

a platform assembly having a mass and being shiftable between a stowed configuration and a performance configuration, having a unitary platform presenting an upwardly directed performance surface when in the performance configuration and an opposed underside, the underside having a plurality of collapsible legs operably coupled thereto, the collapsible legs being shiftable between a collapsed configuration substantially flush with the underside and an extended configuration substantially transverse to the underside, the collapsible legs being telescoping for selectable positioning in the performance configuration in two different heights with respect to a supporting floor, each of the collapsible legs further including an extendable leg portion, the extendable leg portion being positionable between a retracted disposition substantially enclosed within an interior bore defined in a portion of the collapsible leg and an extended disposition, each extendable leg portion including a plurality of lugs, each of the lugs being disposed in a corresponding blind slot defined in the collapsible leg when the extendable leg portion is in the extended disposition; and a platform base assembly operably coupled to the platform assembly, the platform base assembly being shiftable between a stowed configuration and a performance configuration and having means for counterbalancing the mass of the platform assembly to minimize the effort required of an operator to shift the platform assembly between the stowed configuration and a performance configuration.

12. The portable stage platform of claim 11 wherein each collapsible leg has a through slot defined therein corresponding to each of the lugs, each of the lugs being passable through the corresponding through slot when the extendable leg portion is shifted from the extended disposition to the retracted disposition.

13. The portable stage platform of claim 1 wherein each of the collapsible legs further includes at least one folding sidebrace, the folding sidebrace being shiftable between a folded configuration being substantially flush with the underside of the platform and an extended locked configuration supporting the collapsible legs.

14. The portable stage platform of claim 13 wherein each of the at least one folding sidebraces includes a first leg pivotally coupled to a second leg, the first leg being substantially disposed within a channel defined by the second leg when the folding sidebrace is in the folded configuration.

15. The portable stage platform of claim 14 wherein each of the at least one folding sidebraces includes a lock for locking the first and second legs in the extended locked configuration, the lock being slidably disposed in an aperture defined in one of the first and second legs.

16. The portable stage platform of claim 15 wherein the lock is slidable between a disposition locking the first and second leg of the sidebrace in the extended locked configuration and a lock unlocked disposition.

17. The portable stage platform of claim 16 wherein the lock has a face, the face being presented to an engaging portion of the other of the first and second legs, the engaging portion bearing on the face when the sidebrace is transitioned from the lock unlocked disposition to the disposition locking the first and second leg of the sidebrace, the engaging portion acting on the face to overcome the lock bias.

18. The portable stage platform of claim 17 wherein the lock has a locking groove disposed proximate the face, the lock being biased to substantially enclose the engaging portion when the engaging portion passes beyond the face to the locking groove.

19. A platform base assembly for use with and operably connectable to a portable one-piece stage platform, the portable stage platform having a platform assembly having a mass and being shiftable between a stowed configuration and a performance configuration, having a platform presenting an upwardly directed performance surface when in the performance configuration and an opposed underside, the underside having a plurality of collapsible legs operably coupled thereto, the collapsible legs being shiftable between a collapsed configuration substantially flush with the underside and an extended configuration substantially transverse to the underside, the platform base assembly comprising:

means for shifting the platform base assembly between a stowed configuration and a performance configuration and means for counterbalancing the mass of the platform assembly to minimize the effort required of an operator to shift the platform assembly between the stowed configuration and the performance configuration.

20. A platform base assembly for use with and operably connectable to a portable one-piece stage platform, the portable stage platform having a platform assembly having a mass and being shiftable between a stowed configuration and a performance configuration, having a platform presenting an upwardly directed performance surface when in the performance configuration and an opposed underside, the underside having a plurality of collapsible legs operably coupled thereto, the collapsible legs being shiftable between a collapsed configuration substantially flush with the underside and an extended configuration substantially transverse to the underside, the platform base assembly comprising:

means for shifting the platform base assembly between a stowed configuration and a performance configuration and means for counterbalancing the mass of the platform assembly to minimize the effort required of an operator to shift the platform assembly between the stowed configuration and the performance configuration the means for counterbalancing the mass of the platform assembly being extendable and being lockable in any partially extended disposition between an extended disposition and a retracted disposition.

21. The platform base assembly of claim 20 further including means for selectively locking and unlocking the means for counterbalancing the mass of the platform assembly.

22. The platform base assembly of claim 21 further wherein the means for selectively locking and unlocking the means for counterbalancing the mass of the platform assembly is foot operable by an operator.

23. The platform base assembly of claim 21 further wherein the means for counterbalancing the mass of the platform assembly is a plurality of gas springs.

24. The platform base assembly of claim 23 further wherein each gas spring of the plurality of gas springs has a first end operably coupled to a support arm, the support arm being operably pivotally coupled at a support arm first end to the platform assembly.

25. The platform base assembly of claim 24 further wherein the support is pivotally coupled at a support arm second end to a portion of the platform base assembly, extension of the plurality of gas springs acting to pivot the support arm in an arc about the support arm second end.

26. The platform base assembly of claim 19 wherein the platform base assembly includes two spaced apart axles, the axles defining a trapezoidal space therebetween and presenting an outwardly directed opening for receiving the axles of an adjacent platform base assembly when the platform base assembly and the adjacent platform base assembly are in a nested relationship.

27. A portable stage platform, comprising;

a platform assembly having a mass and being shiftable between a stowed configuration and a performance configuration, having a platform presenting an upwardly directed performance surface when in the performance configuration and an opposed underside, the underside having a plurality of collapsible legs operably coupled thereto, the collapsible legs being shiftable between a collapsed configuration substantially flush with the underside and an extended configuration substantially transverse to the underside; and a platform base assembly operably coupled to the platform assembly, the platform base assembly being shiftable between a stowed configuration and a performance configuration and having means for counterbalancing the mass of the platform assembly to minimize the effort required of an operator to shift the platform assembly between the stowed configuration and a performance configuration;

the platform base assembly including two spaced apart axles, the axles defining a trapezoidal space therebetween and presenting an outwardly directed opening for receiving the axles of an adjacent portable stage platform when the portable stage platform and the adjacent portable stage platform are in a nested relationship.

* * * * *

UNITED STATES PATENT AND TRADEMARK OFFICE

CERTIFICATE OF CORRECTION

PATENT NO :6,006,680

DATED :December 28, 1999

INVENTOR(S) :Quam et al.

It is certified that error appears in the above-identified patent and that said Letters Patent is hereby corrected as shown below:

Column 1, line 6, after "at" insert --a--.

Column 1, line 26, after "adjustability" insert --.-- and capitalize the first letter of "further".

Column 4, line 16, delete "is it" and insert --it is--.

Column 9, line 28, after "Fig. 15" delete "," and insert --.--.

Column 12, line 50, delete "selectable" and insert --selectably--.

Column 14, line 21, delete "21" and insert --22--.

Signed and Sealed this

Fourteenth Day of November, 2000

*Attest:*

Q. TODD DICKINSON

*Attesting Officer*

*Director of Patents and Trademarks*